US005167745A

United States Patent [19]

Governale

[11] Patent Number: 5,167,745

[45] Date of Patent: Dec. 1, 1992

[54] METHOD FOR CONSOLIDATION OF FIBROUS NONWOVEN STRUCTURES

[76] Inventor: Claudio Governale, Via Venezia, 44, 35100 - Padova, Italy

[21] Appl. No.: 528,200

[22] Filed: May 25, 1990

[30] Foreign Application Priority Data

May 26, 1989 [IT] Italy ..... 41612 A/89

[51] Int. Cl.[5] ..... B32B 31/00; D04H 1/04

[52] U.S. Cl. ..... 156/285; 28/104; 156/296; 156/497; 425/83.1

[58] Field of Search ..... 156/166, 167, 296, 285, 156/181, 308.2, 62.6, 62.2; 264/126; 28/103, 104; 19/296, 301; 425/83.1, 80.1

[56] References Cited

U.S. PATENT DOCUMENTS

| | | | |
|---|---|---|---|
| 3,314,840 | 4/1967 | Lloyd et al. | 156/167 |
| 3,441,468 | 4/1969 | Siggel et al. | 156/167 x |
| 3,616,031 | 10/1971 | Fleissner | 156/308.2 X |
| 3,617,417 | 11/1971 | Olson | 156/296 X |
| 3,619,322 | 11/1971 | Fleissner | 156/308.2 X |
| 3,841,933 | 10/1974 | Fleissner | 156/181 X |
| 4,011,124 | 3/1977 | Baxter | 156/181 X |
| 4,265,954 | 5/1981 | Romanek | 156/181 X |
| 4,542,060 | 9/1985 | Yoshida et al. | 28/103 X |
| 4,753,693 | 6/1988 | Street | 156/285 X |
| 4,754,527 | 7/1988 | Gilhaus | 28/104 X |
| 4,812,284 | 3/1989 | Fleissner | 156/285 X |
| 4,818,318 | 4/1989 | McMahon et al. | 156/166 |

*Primary Examiner*—Michael W. Ball
*Assistant Examiner*—Adrienne C. Johnstone
*Attorney, Agent, or Firm*—Hoffman, Wasson & Gitler

[57] ABSTRACT

A process for the consolidation of fibrous non woven structure, characterized in that, after having placed the fibrous structure to be consolidated on a pierced surface conveyor, its superior face is run over by blown air jets and, at the same time, undergoes a suction through said pierced conveyor, the blowing pressure and the suction underpressure being chosen so that the loss of head caused by the web, together with the supporting conveyor, causes a substantial expansion of the air jets, near to the web itself.

3 Claims, 2 Drawing Sheets

METHOD FOR CONSOLIDATION OF FIBROUS NONWOVEN STRUCTURES

The present invention relates to a process for the consolidation of a nonwoven fibrous structure and machinery to implement the process.

Various industrial fields use, for very different aims, nonwoven materials of various thicknesses and shapes.

Nonwoven materials are generally made of natural or synthetic fibers. The fibers are first carded and placed on a mobile surface so as to generate a disorderly structure, generally called a web, with uniform thickness. Later, this web is passed through bonding fluid jets, which generally consist of hot air or cold water. In the first case the hot air softens or melts the web fibers, thus bonding them, while in the second case, the cold water opens the fibers with violence so as to interlace them.

The machinery using hot air as a bonding fluid generally includes a conveyor, with a pierced surface. The conveyor moves the web through a suction fan which generates individual very strong hot air jets.

These jets, heated by their closeness to a heating source placed over the belt conveyor, soften or melt the web fibers as they pass around them. As a result, the fibers are taken away and have holes created therein.

A main drawback of these machines consists of the fact that the web obtained undergoes a certain loss of weight.

Another drawback is the difficulty associated with controlling the speed, the capacity, the temperature of the air flow and, consequently, the pressure on web. This can create problems with the control over the softening and fusion of fibers, as well as on the final product quality.

The machines using cold water jets as a bonding element are substantially similar to the machinery previously described above. This similarity is with regard to their working. However, the two machines create webs having a different bonded structure.

In fact, water jets do not create holes as occurs with hot air jets, by taking away the fibers as they pass through and around. Rather, they open and at the same timer interlace fibers among them.

The structure obtained as a result of the cold water jets has more resistance and no loss of weight after the bonding process.

The main drawback of this machinery is that the water jets must have a very high pressure to move, open and interlace the web fibers, especially when the fibers are very thick. For this reason, very powerful and expensive compressors must be used.

Further, the bonding process wets the web. As a result the web must be further worked and dried with the usage of expensive dryers.

All of these drawbacks are eliminated by the instant process for the consolidation of fibrous nonwoven structures which is set forth below. The process is characterized in that, after having placed the fibrous structure to be consolidated on a pierced surface conveyor, its superior face is run over by air jets while at the same time it undergoes a suction through the said pierced conveyor. This process takes place with the blowing pressure and the suction vacuum being designed so that the loss of head caused by the web, together with the supporting conveyor, causes a sensible expansion of the air flow pipe near to the web itself.

To implement the process, the invention foresees machinery including:

two pierced conveyors running, at least for a short portion, facing each other and working with similar peripheral speeds such as to let the structure to be consolidated go on, a compressor placed on the same side of one of the two conveyors, opposite to the structure to be consolidated, wherein the compressor is able to generate various air jets, which pass through both the two conveyors and the structure, a suction pump placed opposite the other conveyor and opposite to the structure to be consolidated, wherein the suction pump is provided with an air jet conveyor in the suction pipe and the pressure of said pump is less than that of the air compressor.

This invention is herebelow further clarified with reference to the enclosed drawings in which.

Figure 1:
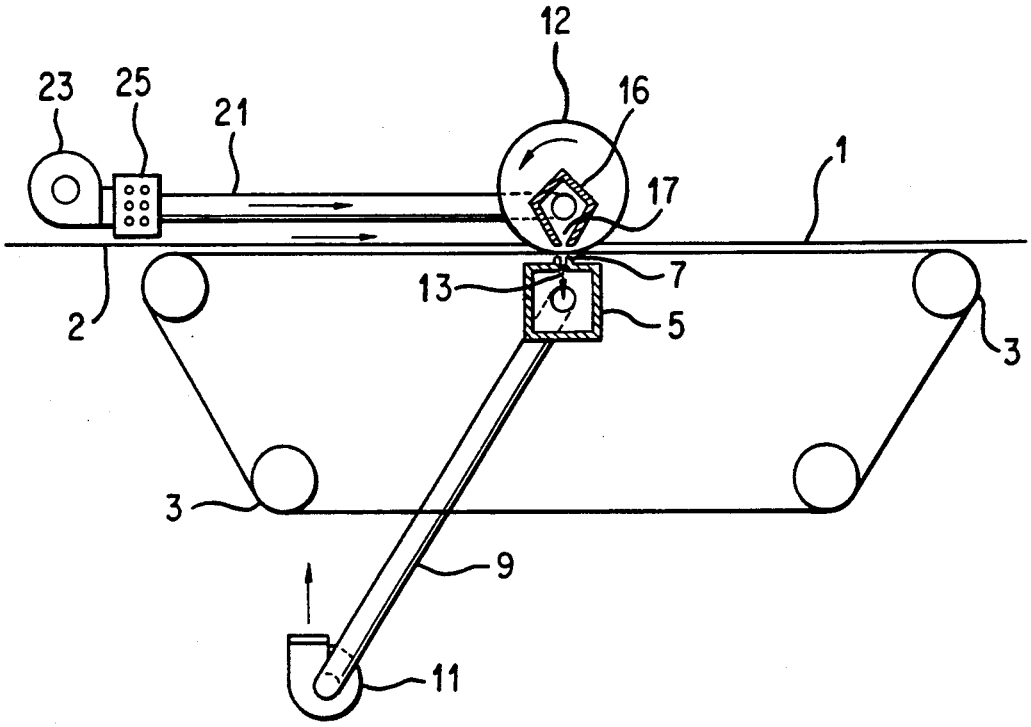
FIG. 1 shows in front view the machinery for the consolidation of fibrous nonwoven structures.

As can be seen from the drawings, the machinery includes, in the embodiment shown in FIG. 1, a belt conveyor, generally consisting of a net, maintained in tension between rolls 3 bound to the machine frame (not shown in the drawings).

Inside the belt conveyor a suction box 5 is provided, with a slit 7 running crosswise it, whose clearance can be settled by traditional methods. The suction box 5 is connected, through a pipe 9, to a pump 11. Near to the slit 7 of suction box 5, over the belt conveyor 1, another conveyor is provided, consisting of a pierced cylinder 12. This conveyor is supported by rolling and suspension tools, bound to the machine frame.

Inside the pierced cylinder 12, a blowing box 16 is mounted. The blowing box has substantially a shape like a parallelepiped, with a slit 17 tapered toward the downside and facing the corresponding slit 7 of the suction box 5.

The blowing box 16 is connected, through a pipe 21, to a compressor 23.

Inside the blowing box 16, or at the outlet of the compressor 23, a heating source 25 can be placed. The heating source may, for example, consist of an electrical resistance.

The pierced cylinder 12 is driven so that its tangent speed is equal to the advancing speed of the belt conveyor 1.

The machine operates in the following manner. A web 2, made of simple loose fibers, its conveyed to the conveyor 1. The loose fibers pass on the conveyor under the cylinder 12 and over the suction box 5.

When the fibers free of the web 2 are between the slit 17 of the blowing box 16 and the slit of the suction box 5, they are run over by the blown air generated by the compressor 23. The air passes through the pierced cylinder 12 and is then shared into various minor jets. The air blown inside the blowing box 16 is heated as a result of its closeness with the heating source 25.

The air jets 13 press the web 2 in different ways, depending on resistance and shape of the conveyor 1. They pass through the web 2 in preferential zones, depending on the structure of the conveyor 1, and are sucked in by pump 11.

The blowing pressure and the suction vacuum can be designed, so that the loss of head, caused by the web 2 and the conveyor supporting it, creates a substantial expansion of the air jet 13 near the web 2 itself.

The expansion opens the fibers and welds them through melting or softening.

The process described above and the machinery that allows its application have numerous advantages, in particular:

they allow for the production of a web with a stronger mechanical structure;

they improve fiber distribution depending on the thickness and the kind of structure desired, as well as the density and features of the fibers used;

they substantially decrease the production costs and time;

they allow the means to build a machine with low management and manufacturing costs.

Figure 2:
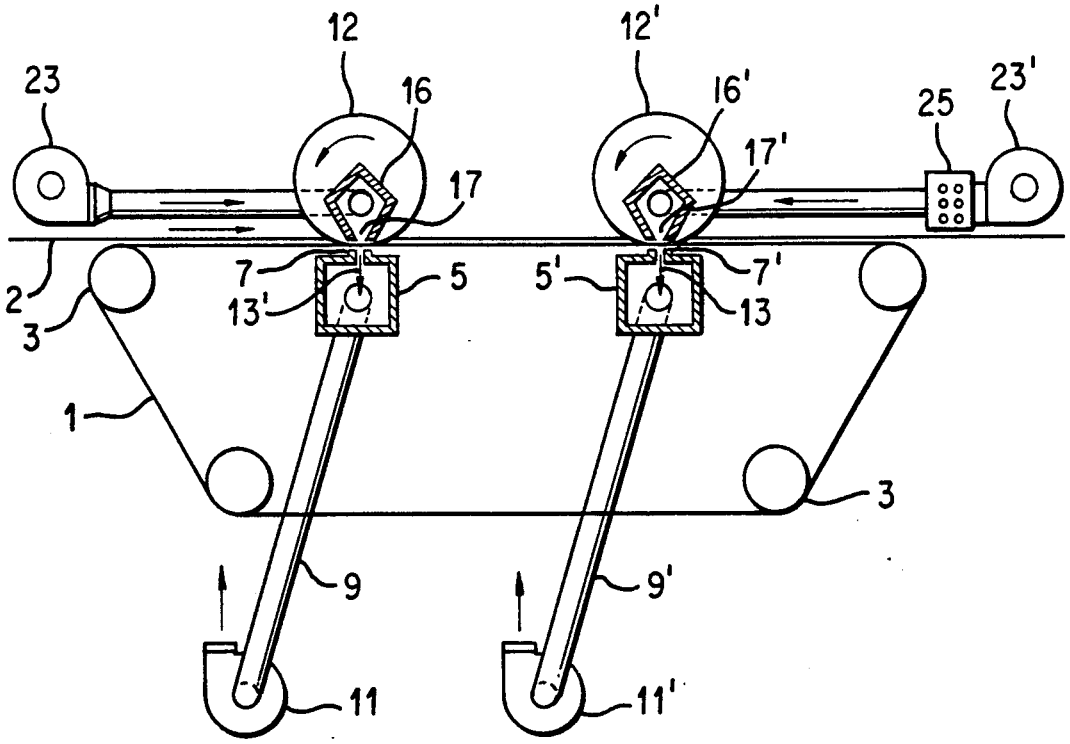
FIG. 2 shows it in a second embodiment.

In the embodiment shown in FIG. 2, the machinery includes two units for the consolidation of a web 2. The embodiment is similar in all its parts with respect to the one already described.

In particular, it includes a conveyor internally provided with two suction boxes 5, 5' and slits 7, 7' running across the respective suction boxes. The slits' widths can be settled with traditional methods.

These suction boxes 5, 5' are respectively connected through pipes 9, 9' to suction pumps 11, 11'.

Near the slits 7, 7' of suction boxes 5, 5', over the belt conveyor 1, two pierced drums 12, 12' are provided.

Inside the pierced drums 12, 12', two blowing boxes 16, 16' are assembled, with slits 17, 17' tapered toward the downside and facing the corresponding slits 7, 7'. The boxes 16, 16' are connected to compressors 23, 23'.

Inside the blowing box 16', or at the outlet of the compressor 23', a heating source 25 can be placed. For example, the heat source may be an electric resistance.

The machinery operates in the following manner. As previously discussed, the web 2 passes, by means of the conveyor 1, though the gap of the first unit between slit 17 and suction box 5.

When the fibers free of the web 2 are between the slit 17 of the empty casing 16 and the slit 7 of the suction box 5, they are run over by various cold air jets 13' generated by the compressor 23. These jets 13' pass through the web 2; the jets press the web 2 and are sucked in by pump 11.

Later, the fibrous structure, already pierced at various points, passes through the second unit, whose pierced cylinder is synchronized with the rotating movement of the previous unit cylinder.

When the web fibers, which are already interlaced, are between the slit 17' of the blowing box 16' and the slit 7' of the suction box 5', they are run over by hot air jets 13 generated by the compressor 23'.

These jets 13 pass through the holes in the web 2, which were previously created by the cold air jets 13'. These hot air jets 13 further open the fibers and weld them by local melting or softening.

This second embodiment presents the same advantages associated with the machinery previously described that includes a single consolidation unit. However, it allows a more uniform and defined consolidated structure.

The use of only hot air jets to open and weld web fibers can cause a disorderly melting or softening of fibers.

The disorder depends on the different resistance to the moving of fibers. These differences are especially present in thick webs and cause differences in the period of contact between the hot air jet and the fiber.

When the web 2 is already pierced, the hot air jet does not meet particular resistances as it passes through the web 2; instead, it passes over the fibers uniformly all along the thickness of the web 2.

Figure 3:
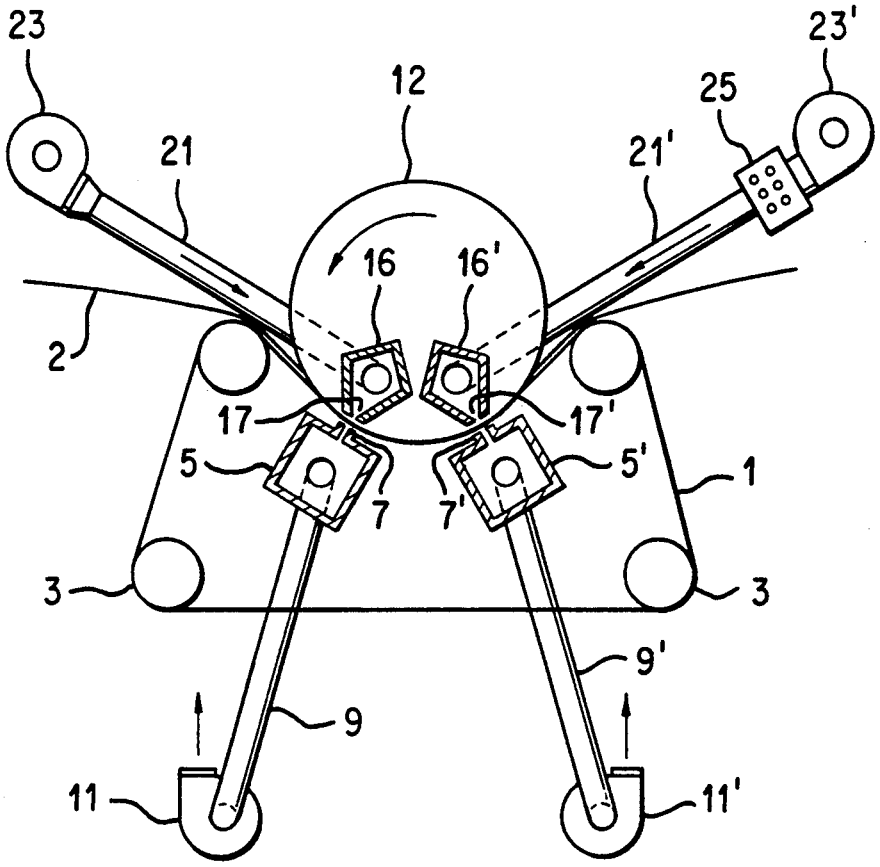
FIG. 3 shows it in a third embodiment.
Figure 4:
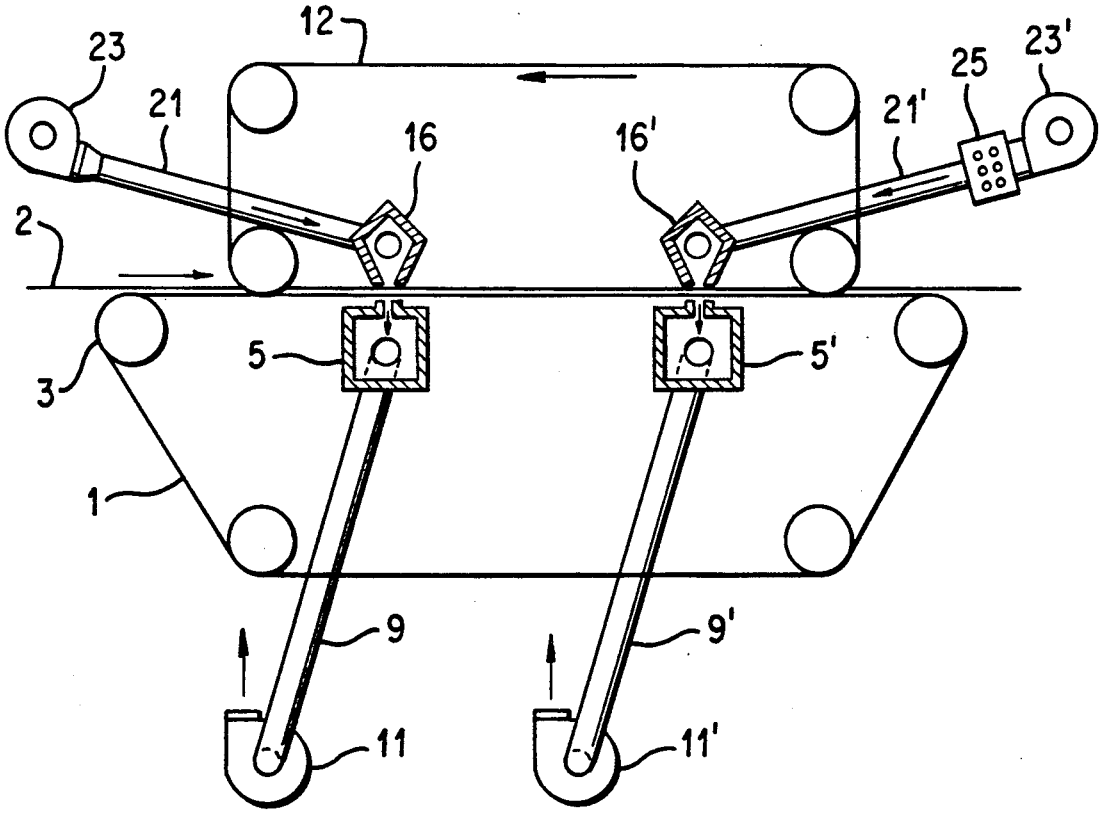
FIG. 4 shows it in a fourth embodiment.

The embodiment shown in FIGS. 3 and 4 have the same advantages of the previously described machinery, while they differ as to the presence of two consolidation units. In particular, the blowing boxes 16, 16' are placed inside a single pierced cylinder or a pierced closed-ring-like conveyor.

In the fist case, the conveyor 1 is partially adapted to the circumference of cylinder 12 to allow the web to be first run over by the cold air jets and later by the hot ones.

I claim:

1. A process for the thermal bonding of a fibrous nonwoven structure comprising the steps of placing the fibrous structure to be bonded on a net conveyor;

passing the fibrous structure through a gap between a sieve rotating cylinder and a facing slitted box, wherein said sieve rotating cylinder has a central rotating axis and said facing slitted box includes a longitudinal slit that is parallel to said central rotating axis, and said sieve rotating cylinder has a tangential speed substantially equal to the net conveyor's speed;

subjecting one surface of the fibrous structure to heated blown air jets coming from apertured zones of the sieve rotating cylinder;

subjecting the other surface of the fibrous structure to the action of a suction means connected to said slitted box;

wherein the heated blown air jets and the suction means are settled such that the pressure drop through the gap causes a substantial expansion of the heated blown air jets through the fibrous structure.

2. A process for the thermal bonding of a fibrous nonwoven structure according to claim 1, wherein the fibrous structure to be bonded is run over by said heated blown air jets to open and at the same time weld the fibers of the fibrous structure.

3. A process for the thermal bonding of a fibrous nonwoven structure according to claim 1, wherein the fibrous structure is passed between a pierced rotating cylinder blowing cold air jets and a facing slitted suction box before the fibrous structure is subjected to thermal bonding, such that the cold air jets open the fibrous structure prior to the application of the heated blown air jets.

* * * * *